US006637958B2

(12) United States Patent
Smith

(10) Patent No.: US 6,637,958 B2
(45) Date of Patent: Oct. 28, 2003

(54) PRINTING SYSTEM WITH ADJUSTABLE CARRIAGE RAIL SUPPORT

(75) Inventor: Daniel E. Smith, New Hampton, NH (US)

(73) Assignee: VUTEk, Inc., Meredith, NH (US)

( * ) Notice: Subject to any disclaimer, the term of this patent is extended or adjusted under 35 U.S.C. 154(b) by 0 days.

(21) Appl. No.: 10/055,614

(22) Filed: Oct. 29, 2001

(65) Prior Publication Data

US 2002/0159808 A1 Oct. 31, 2002

Related U.S. Application Data

(60) Provisional application No. 60/244,299, filed on Oct. 30, 2000.

(51) Int. Cl.[7] ..... B41J 25/308

(52) U.S. Cl. ..... 400/354.3; 400/352; 400/59; 400/55; 347/8

(58) Field of Search ..... 400/56, 59, 354, 400/352, 354.3, 55, 57; 347/8, 37

(56) References Cited

U.S. PATENT DOCUMENTS

| | | | | | |
|---|---|---|---|---|---|
| 4,072,101 | A | | 2/1978 | La Garcia et al. | 101/93.15 |
| 4,906,115 | A | * | 3/1990 | Bischof | 400/55 |
| 5,000,590 | A | * | 3/1991 | Einem | 400/55 |
| 5,195,836 | A | | 3/1993 | Longust et al. | 400/354 |
| 5,227,809 | A | | 7/1993 | Carpenter et al. | 346/1.1 |
| 5,592,202 | A | | 1/1997 | Erickson | 347/37 |
| 5,678,936 | A | * | 10/1997 | Hino | 400/55 |
| 5,805,183 | A | | 9/1998 | Lidke et al. | 347/41 |
| 5,871,292 | A | | 2/1999 | Johnson et al. | 400/328 |
| 6,379,064 | B1 | * | 4/2002 | Giles et al. | 400/691 |
| 6,394,568 | B1 | * | 5/2002 | Menendez | 347/8 |
| 6,394,672 | B1 | * | 5/2002 | Murray et al. | 400/58 |
| 6,450,710 | B1 | * | 9/2002 | Foster et al. | 400/58 |
| 6,565,272 | B2 | * | 5/2003 | Kelley et al. | 400/59 |

* cited by examiner

*Primary Examiner*—Andrew H. Hirshfeld
*Assistant Examiner*—Dave A. Ghatt
(74) *Attorney, Agent, or Firm*—Hamilton, Brook, Smith & Reynolds, P.C.

(57) ABSTRACT

A positioning system for a carriage in a printing system includes a support plate having a groove along a length of the plate, and a rail positioned along the groove. A first adjusting mechanism is used to adjust the position of the rail in a first direction, and a second adjusting mechanism is used to adjust the position of the rail in a second direction that is substantially normal to the first direction.

11 Claims, 6 Drawing Sheets

PRINTING SYSTEM WITH ADJUSTABLE CARRIAGE RAIL SUPPORT

RELATED APPLICATION

This application claims the benefit of U.S. Provisional Application No. 60/244,299, filed on Oct. 30, 2000. The entire teachings of the above application are incorporated herein by reference.

BACKGROUND

Certain types of printing systems are adapted for printing images on large-scale substrates, such as museum displays, billboards, sails, bus boards, and banners. Some of these systems use so-called drop on demand ink jet printing. In these systems, a piezoelectric vibrator applies pressure to an ink reservoir of the print head to force the ink out through the nozzle orifices positioned on the underside of the print heads. A particular image is created by controlling the order at which ink is ejected from the various nozzle orifices.

In some of these systems, a carriage which holds a set of print heads scans across the width of a flexible substrate while the print heads deposit ink as the substrate moves. In another type of system, a solid, non-flexible substrate is supported on a table. The carriage holding the print heads has two degrees of motion so that it is able to move along the length as well as the width of the substrate as the print heads deposit ink onto the substrate. And in yet another arrangement, a solid, non-flexible substrate is held to a table as the entire table and substrate move together s along one axis of the substrate under the print heads as the carriage holding the print heads traverses in a direction normal to that axis while the print heads deposit ink to create a desired image.

SUMMARY

During the printing process, as the carriage traverses along a pair of rails, the position of the carriage may vary because of the rails are not positioned to be precisely parallel to each other or within a plane. In some prior art systems, the rails are supported on a milled or machined support structure, or the rails are epoxied to a support structure. In these prior art systems, it is very difficult to readily adjust the position of the rails to within a desired tolerance. It is desirable, therefore, to adjust the position of the rails such that they are parallel to each other and are parallel relative to a common plane to within a desired tolerance.

In one aspect of the invention, a positioning system for a carriage in a printing system includes a support plate having a groove along a length of the plate, and a rail positioned along the groove. A first adjusting mechanism is used to adjust the position of the rail in a first direction, and a second adjusting mechanism is used to adjust the position of the rail in a second direction that is substantially normal to the first direction.

Embodiments of this aspect can include one or more of the following features. The groove can be shaped such that the rail makes a two-point contact with the groove along the length of the rail. The support plate has a second groove along the length of the plate located on an opposite side of the plate across the width of the plate. The first and the second groove are substantially parallel to each other. There can be a second rail positioned in the second groove. The position in the first direction can be maintained to a tolerance of about ±0.0005 inch, and the position in the second direction can be maintained to a tolerance of about ±0.0005 inch. The first and the second adjusting mechanisms can be jack-screw mechanisms.

In a related aspect, a method of positioning a carriage holding a set of print heads includes adjusting the position of a rail aligned along a groove of a support plate in a first direction with one or more first adjusting mechanisms, and adjusting the position of the rail in a second direction that is substantially normal to the first position with one or more second adjusting mechanisms.

The method can include adjusting the position of a second rail aligned along a second groove of the support plate that is substantially parallel to the first groove in the first direction with one or more of the first adjusting mechanisms. The first groove and the second groove can be located on opposite sides of the plate across the width of the plate. In some embodiments, the method includes adjusting the position of the second rail in the second direction with one or more of the second adjusting mechanisms. The adjusting mechanisms can be jack-screw mechanisms.

Among other advantages, the present invention provides a cost-effective means for an operator of the positioning system to quickly align the rails with just two sets of adjusting mechanisms. Further, the rails can be presciely positioned within a desired tolerance. Even if a support beam to which the plates are secured sags, for example, in an unsupported midsection portion of the beam, an operator can easily compensate for this sag by adjusting the position of the rails so that they remain parallel to each other and to a common plane. Further, the combination of the rails and the support plates form a stiff truss. This truss structure is stable and dampens any motion imparted on the structure thereby minimizing any motion transmitted to the carriage, hence, minimizing any undesirable carriage motion.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
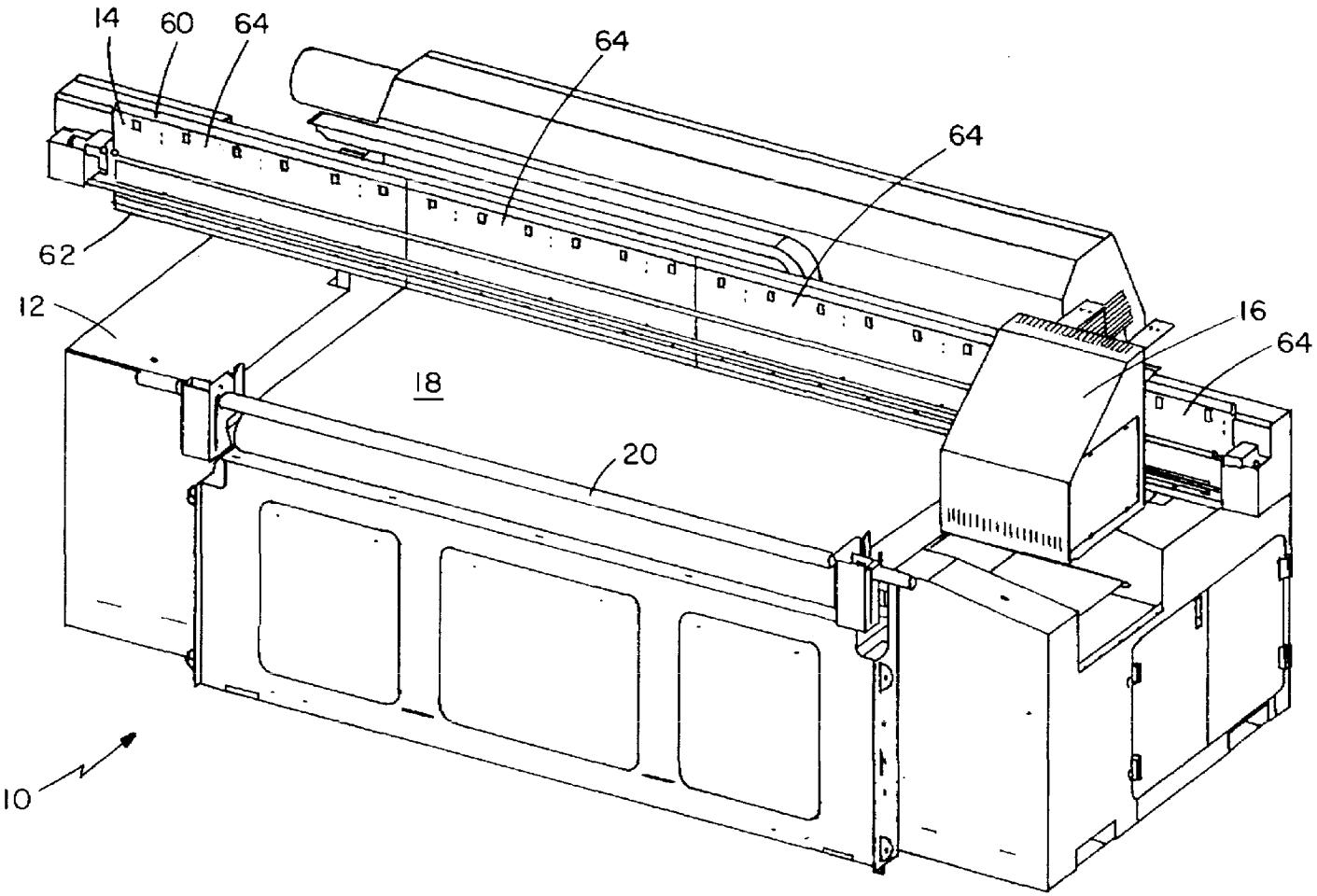
FIG. 1 is an perspective view of a printing system in accordance with the present invention.

Referring to FIG. 1, there is shown a printing system 10 that prints on both flexible and non-flexible substrates. Further, the printing system 10 is able to accommodate substrates with various thickness automatically during the printing process.

The printing system 10 includes a base 12, a rail system 14 attached to the base 12, a transport belt 18 which moves a substrate though the system, and a substrate thickness indicator roller 20. A carriage 16 holding a set of print heads 17 (shown in phantom) is supported by and traverses along the rail system 14.

Figure 2A:
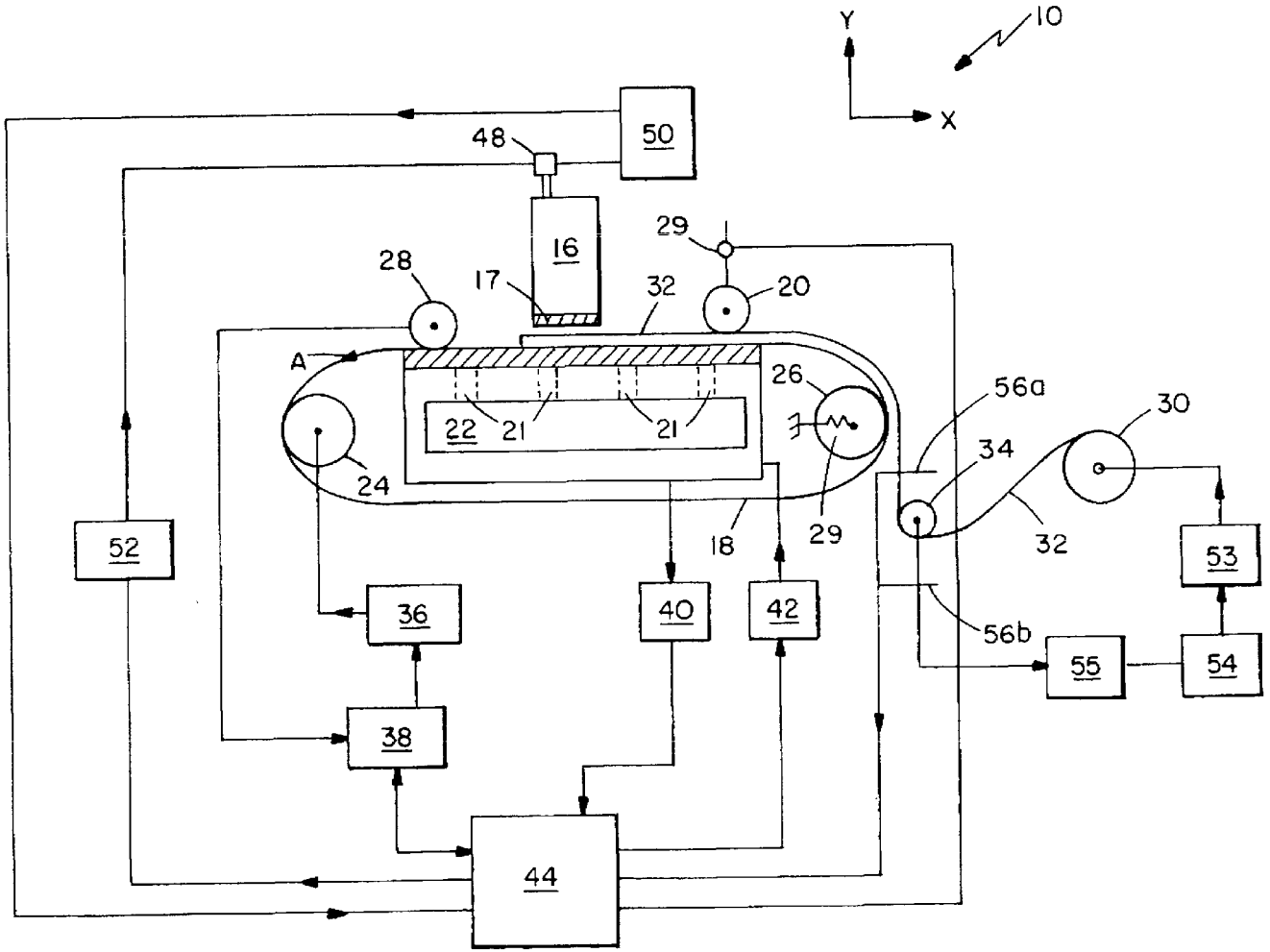
FIG. 2A is a cross-sectional and block diagram view of the printing system of FIG. 1.
Figure 2B:
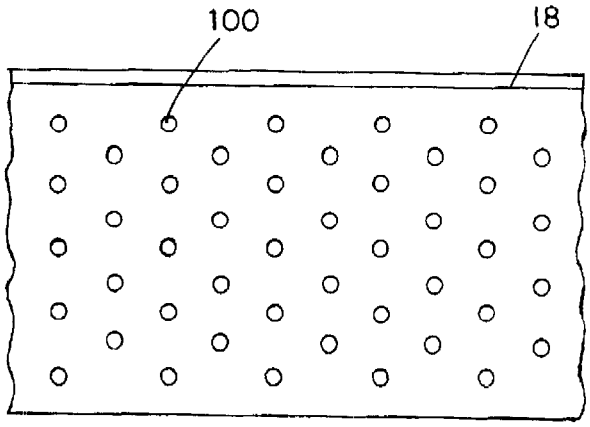
FIG. 2B is a top view of a transport belt of the printing system of FIG. 1.

Referring further to FIG. 2, the set of print heads 17 which are typically positioned from about 0.04 inch to about 0.08 inch from a substrate 32 as the substrate moves through the system by the transport belt 18. A carriage motor 48 such as, for example, a servo motor or any other suitable drive mechanism, of the carriage 16 is connected to a feedback device 50 and a carriage motor controller 52. The motor controller 52 as well as the feedback device 50 transmit signals to a controller such as a central CPU 44.

As mentioned above, the printing system 10 is able to automatically accommodate changes in the thickness of the substrate. For example, if the thickness of the substrate increases or if the substrate is thicker than the previous substrate, as the substrate moves through the system, the indicator roller 20 which sits on top of the substrate rises. The increased thickness is detected in turn by a dial indicator 29 that is attached to the indicator roller 20. This increased thickness information is transmitted from the dial indicator 29 to the CPU 44. The CPU 44 then transmits a signal to the controller 52 to instruct the carriage motor 48 to move carriage 16 and hence the print heads 17 upwards away from the substrate. Meanwhile, the position of the carriage is relayed to the feedback device 50 and in turn to the CPU 44 which then determines if further finer adjustments are needed to position print heads 17 at the proper height. Thus regardless of the thickness and/or stiffness of the substrate, the printing system 10 maintains a precise desired gap between the print heads 17 and the substrate 32. The printing system 10 is able to automatically accommodate a change in thickness of the substrate in about five seconds. In sum, the printing system 10 is capable of handling flexible substrates as well as solid non-flexing substrates with various thicknesses "on the fly" with minimal or no intervention from an operator.

To prevent the substrate from slipping on the transport belt 18, the printing system 10 also includes a vacuum table 22 provided with a set of holes 21. A vacuum motor 42 supplies the vacuum to the vacuum table 22, and the vacuum is detected by a vacuum sensor 40. Both the vacuum sensor 40 and the vacuum motor 42 are connected to and under the direction of the CPU 44 which receives and transmits the appropriate signals to maintain the desired vacuum. In the illustrated embodiment, the vacuum provided by the vacuum table 22 is approximately in the range −0.05 psi to −0.3 psi.

The transport belt 18 is provided with holes 100 (FIG. 2B) that extend through the thickness of the belt, each having a diameter of about 0.1 inch, which are spaced apart from one another by about one inch. The belt 18 is a woven polyester made from reinforced polyurethane, and has a thickness of about 0.09 inch. The woven polyester minimizes stretching of the belt 18 and thus provides high stepping accuracy and uniform vacuum distribution. Alternatively, the belt can be made from stainless steel having a thickness of about 0.008 inch.

A porous sheet 43 having a thickness of about 0.5 inch sits between the vacuum table 22 and the transport belt 18. The porous sheet is made from a sintered, porous polyethylene, or any other suitable material. The holes in the belt 18, and the porous sheet 43 assure that a suction is applied to a substrate when a vacuum is provided by the vacuum table 22. In essence, the porous sheet 43 acts as a flow resistor. Thus when the substrate covers only a portion of belt 18, the vacuum provided by the vacuum table 22 does not have to be significantly readjusted, if at all, even as the area over the belt covered by the substrate varies. In sum, with the porous sheet 43, a continuous vacuum can be provided by the vacuum table 22, and no further adjustment to the vacuum level needs to be made as one or more substrates are transmitted through the printing system during the print process. This feature is applicable to both continuous substrates, for example, those supplied from a roll, as well as non-continuous substrates such as a flexible or a rigid sheet supplied individually.

Turning now to the drive mechanism of the printing system 10, the transport belt 18 wraps around a drive roller 24 and an idler roller 26, while an optical encoder wheel 28 and the thickness indicator roller 20 sits on top the belt 18. The idler roller 26 is able to move in the x-direction and through a dynamic tensioning device 29 keeps the belt 18 under a constant tension during the printing process.

A drive motor 36 rotates the drive roller 24 which causes the belt 18 to move in the direction of arrow A, and is connected along with the encoder wheel 28 to a drive controller 38. The encoder wheel 28 detects the precise distance that the substrate moves. This information is relayed to the drive controller 38 and in turn to the CPU 44. The CPU 44 transmits a signal back to the controller 38 which controls the speed of the drive motor 36 so that the distance the substrate moves is precisely controlled. Thus the feedback position signals from the optical encoder 28 compensates for belt thickness variations, seams in the belt, and variations in the diameter of the rollers over time.

In some embodiments, the feed wheel 30 supplies a flexible substrate 32, which wraps underneath a dancer roller 34, to the printing system. The feed wheel 30 is rotated by a feed motor 53 which is controlled by a feed controller 54. Both the feed controller 54 and the dancer 34 are connected to a position sensor 55, and located above and below the dancer 34 is a top limit switch **56*a* and a bottom limit switch 56*b***, respectively.

If during the printing process a jam occurs, the dancer 34 will rise and trigger the top switch **56*a* to send a signal to the central CPU 44 which then directs the printing system 10 to terminate the printing process because a problem has been detected. And if the feed roll 30 becomes depleted of the substrate material 32 during the printing process, the dancer 34 will drop down and trigger the bottom switch 56*b* to transmit a signal to the CPU 44** to shut the printing process off since there is no longer any substrate material.

During the printing process, as the substrate 32 is fed by the feed wheel 30, the position sensor 55 detects the height of the dancer 34. This height information is transmitted to the feed controller 54 which in turn adjusts the power to the feed motor 53 to increase or reduce the feed speed, or to reverse the feed direction of feed wheel 30 such that a constant tension is maintained in the substrate. A constant tension is desired to maintain positional accuracy of the substrate and to remove any wrinkles in the substrate while it moves through the printing system.

Figure 3A:
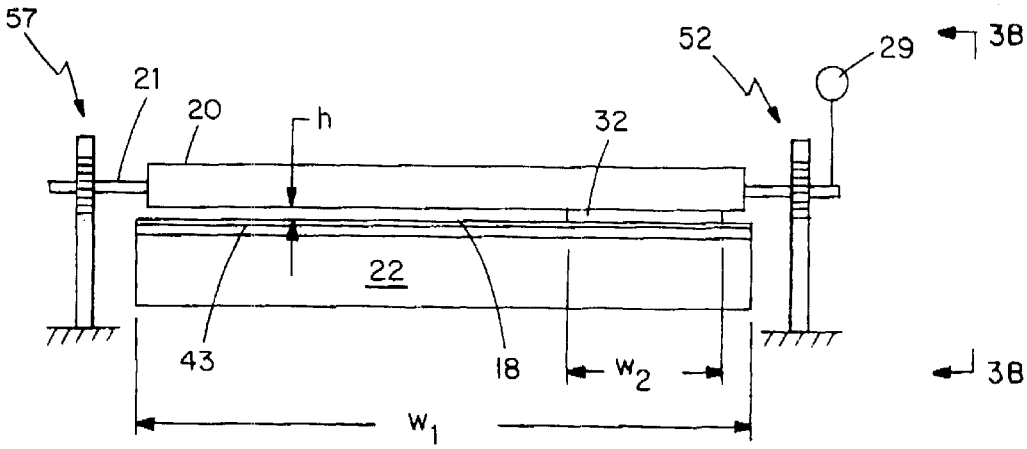
FIG. 3A is an isolated view of a thickness indicator roller of the printing system of FIG. 1.
Figure 3B:
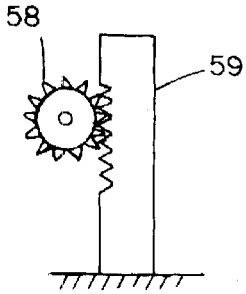
FIG. 3B is a side view of the thickness roller along the line 3B—3B of FIG. 3A.

The printing system 10 can detect thickness variations of the substrate regardless of the width of the substrate or the position of the substrate relative to the width of belt 18. This capability is illustrated in FIGS. 3A and 3B. As shown, the thickness indicator roller 20 rotates freely about a bar 21 that is supported by a pair of ratchet/gear mechanisms 57, each of which includes a gear 58 engaged with a rachet 59. Thus when a substrate causes the height of indicator roller 20 to vary, both of the gears 58 rotate so that the indicator roller 20 is at the same height, "h", along the width, "$w_1$", of the belt 18 regardless of the width, "$w_2$", of the substrate 32 that is fed to the printer system. Note that the vertical position, "y" of the dancer 34 (FIG. 2) is also controlled by a similar ratchet/gear mechanism. Alternatively, a laser triangulation device is used to determine the thickness of the substrate.

Figure 4A:
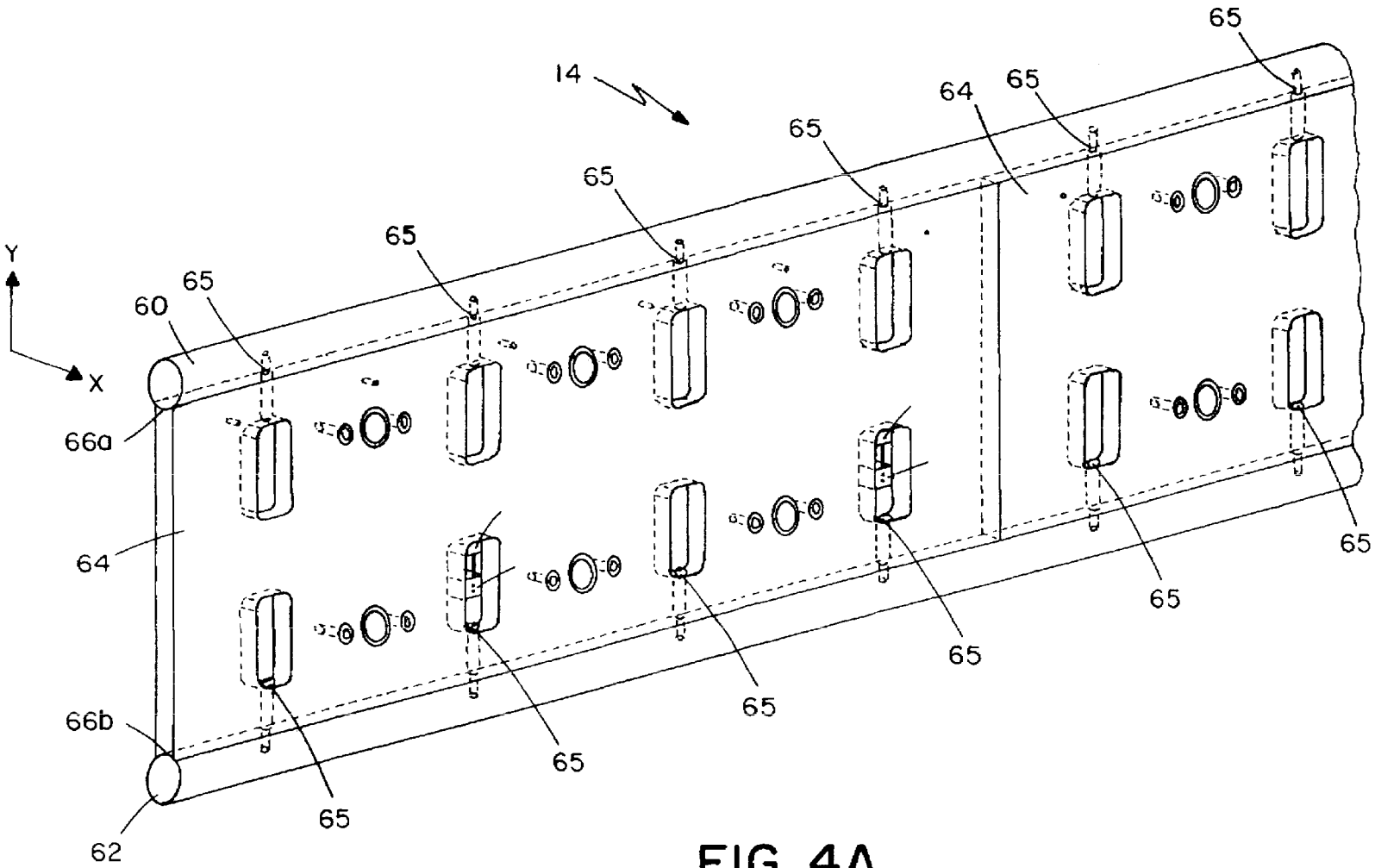
FIG. 4A is an isometric view of a part of a rail system for supporting a carriage of the printing system of FIG. 1.
Figure 4B:
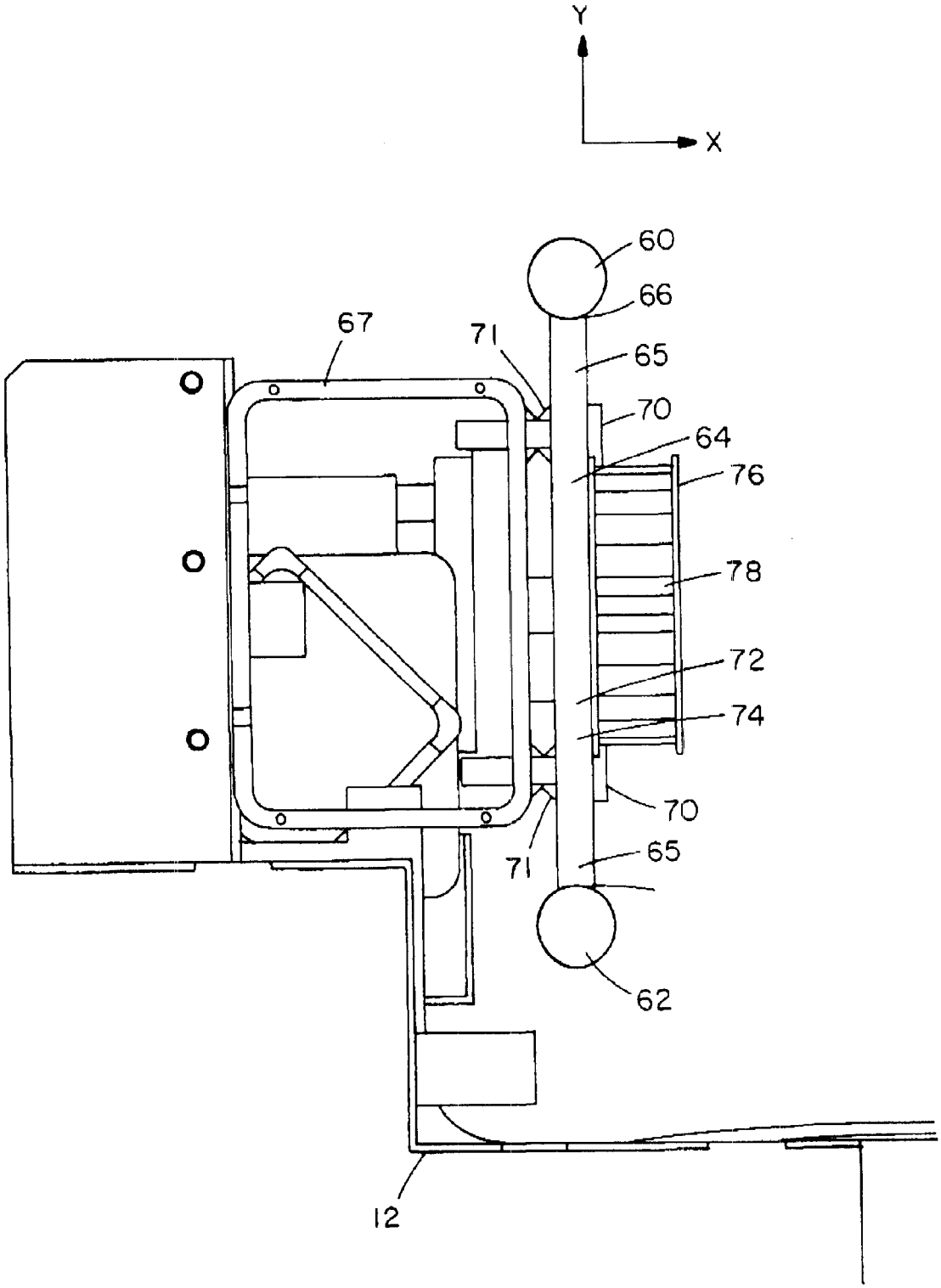
FIG. 4B is a cross-sectional view of the rail system of FIG. 4A shown mounted to a support beam.

Referring now to FIGS. 4A and 4B, the rail system 14 includes a top rail 60 and a bottom rail 62. These rails are attached to a set of spacer support plates 64 by a set of screws 65 along a bottom and a top machined V-groove 66*a* and 66*b*, respectively. These grooves 66 provide a two-point contact with each of the rails 60 and 62. This two-point contact is maintained along the entire length of the rails 60 and 62. The set of support plates 64 is attached to a support beam 67 of the base 12 by a series of set screws 68. The horizontal displacement, "x", of the support plates 64 with respect to the support beam 67 is adjusted by a set of horizontal jack screws 70. Each horizontal jack screw 70 is associated with a bellvile washer 71 that pushes the support plates 64 away from the support beam 67 to assure that the horizontal jack screws 70 are always under tension. The vertical position, "y" of the sup port plates 64 is adjusted by a set of vertical jack screws 72. The vertical jack screws 72 are threaded into a block 74 that is attached to the support beam 67. The machined V-grooves 66, and the jack screws 70 and 72 enable an operator to adjust the position of the rails 60 and 62 so that the rails remain parallel in a plane and parallel to one another to within a tolerance of about ±0.0005 inch which ensures the precise positioning of the print heads 17 relative to substrate.

Figure 4C:
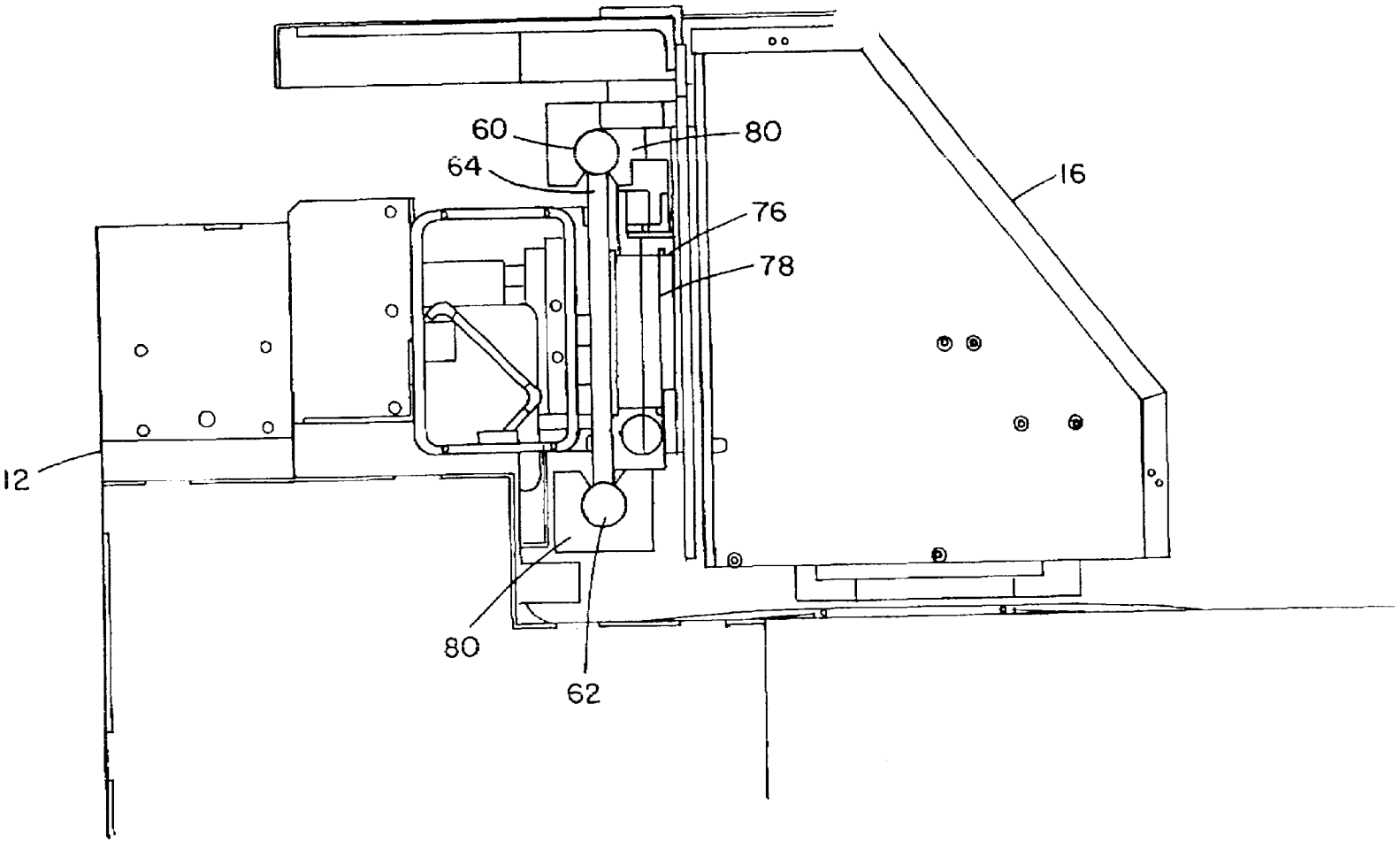
FIG. 4C is a cross-sectional view of the rail system of FIG. 4A shown with the carriage of the printing system.

Also shown in FIGS. 4B and 4C is a pulley 76 and a carriage belt 78 that is attached to the carriage 16. The pulley 76 and another similar pulley, one of which is connected to a motor, are located on either end of the rail system 14. Referring in particular to FIG. 4C, the carriage 16 is provided with a set of sleeve bushings 80 to enable the carriage to slide along rails 60 and 62. Accordingly, as the motor drives the pulley, the carriage 16 traverses partially or fully along the length of the rails 60 and 62.

In use, an operator activates the printer system 10 and places the substrate 32 onto the belt 18. As mentioned above, the vacuum sensor 40 detects the vacuum of the vacuum table 22 as applied to the substrate 32. This information is fed to the CPU 44 which controls the vacuum motor 42 to maintain the desired vacuum. Because porous sheet 43 acts as a flow resistor, large variations in the applied vacuum are not required. In fact, little or no variations in the applied vacuum are required in a typical printing process.

The drive motor 36 rotates the drive roller 24 to move the transport belt 18 and hence the substrate 32 under the print heads 17. Meanwhile, the dynamic tensioning device 29 of the idler roller 26 maintains a constant tension in the belt 18 during the printing operation. The translational movement of the substrate 32 underneath the print heads 17 is monitored by the encoder wheel 28 to ensure that this movement is precisely controlled.

As the substrate moves under the carriage 16 and hence the print heads 17, the carriage 16 traverses back and forth (that is, in and out of the page when referring to FIG. 2A) along the width of the substrate as instructed by the CPU 44, while the print heads 17 deposit ink onto the substrate to create the desired image. The ink can be, for example, solvent pigment inks, UV resistant inks, or water inks. The through put of printing system 10 ranges from about 0.5 ft/min to about 10 ft/min.

As discussed above, changes in the thickness of the substrate are automatically detected by the system. Thus, if a thin, flexible substrate is followed by a thicker, non-flexible substrate, the system automatically without the intervention of the operator adjusts the height of carriage 16 such that the proper gap is maintained between the print heads 17 and the substrate.

While this invention has been particularly shown and described with references to preferred embodiments thereof, it will be understood by those skilled in the art that various changes in form and details may be made therein without departing from the scope of the invention encompassed by the appended claims.

What is claimed is:

1. A positioning system for a carriage in a printing system, comprising:

a support plate having a groove along a length of the plate;

a rail positioned along the groove, the carriage being transported along the rail;

a first adjusting mechanism which positions the rail in a first direction; and a second adjusting mechanism which positions the rail in a second direction substantially normal to the first direction.

2. The positioning system of claim 1, wherein the groove is shaped such that the rail makes a two-point contact with the groove along the entire length of the groove.

3. The positioning system of claim 1, wherein the support plate has a second groove along the length of the plate, the groove being substantially parallel to the first groove and the first groove and the second groove being located on opposite sides of the plate across the width of the plate.

4. The positioning system of claim 3, further comprising a second rail positioned in the second groove.

5. The positioning system of claim 1, wherein the position in the first direction is maintained to a tolerance of about ±0.0005 inch.

6. The positioning system of claim 1, wherein the position in the second direction is maintained to a tolerance of about ±0.0005 inch.

7. The positioning system of claim 1, wherein the first adjusting mechanism and the second adjusting mechanism are jack-screw mechanisms.

8. A method of positioning a carriage holding a set of print heads, comprising:

adjusting the position of a rail in a first direction with one or more first adjusting mechanisms, the rail being aligned along a groove of a support plate; and adjusting the position of the rail in a second direction with one or more second adjusting mechanisms, the second direction being substantially normal to the first direction.

9. The method of claim 8, further comprising adjusting the position of a second rail in the first direction with one or more of the adjusting mechanisms, the second rail being aligned along a second groove of the support plate, the second groove being substantially parallel to the first groove, and the first groove and the second groove being located on opposite sides of the plate across the width of the plate.

10. The method of claim 9, further comprising adjusting the position of the second rail in the second direction with one or more of the second adjusting mechanisms.

11. The method of claim 8, wherein the first and the second adjusting mechanisms are jack-screw mechanisms.

* * * * *